US008324521B2

(12) United States Patent
Li

(10) Patent No.: US 8,324,521 B2
(45) Date of Patent: Dec. 4, 2012

(54) BELLOWS FOR USE IN VACUUM INTERRUPTERS

(75) Inventor: Wangpei Li, Horseheads, NY (US)

(73) Assignee: Eaton Corporation, Cleveland, OH (US)

( * ) Notice: Subject to any disclaimer, the term of this patent is extended or adjusted under 35 U.S.C. 154(b) by 90 days.

(21) Appl. No.: 12/946,133

(22) Filed: Nov. 15, 2010

(65) Prior Publication Data

US 2012/0118858 A1 May 17, 2012

(51) Int. Cl.
*H01H 33/66* (2006.01)

(52) U.S. Cl. ..... 218/118; 218/135

(58) Field of Classification Search ..... 218/118, 218/135

See application file for complete search history.

(56) References Cited

U.S. PATENT DOCUMENTS

| | | | | |
|---|---|---|---|---|
| 3,586,801 | A * | 6/1971 | Saito et al. | 218/137 |
| 4,117,288 | A * | 9/1978 | Gorman et al. | 218/129 |
| 4,585,913 | A * | 4/1986 | Yorita | 218/135 |
| 4,661,665 | A * | 4/1987 | Carroll et al. | 218/141 |
| 4,896,008 | A * | 1/1990 | Aoki et al. | 218/134 |
| 5,286,933 | A * | 2/1994 | Pham | 218/119 |
| 5,898,151 | A * | 4/1999 | Plat et al. | 218/84 |
| 5,952,635 | A * | 9/1999 | Plat et al. | 218/43 |
| 6,114,647 | A * | 9/2000 | Morita et al. | 218/135 |
| 6,593,538 | B2 * | 7/2003 | Perret et al. | 218/3 |
| 7,205,499 | B2 * | 4/2007 | Masnada et al. | 218/136 |

FOREIGN PATENT DOCUMENTS

DE 10 2007 063447 B3 4/2009

OTHER PUBLICATIONS

European Patent Office, "International search report and Written Opinion", Apr. 27, 2012, 10 pages.

* cited by examiner

*Primary Examiner* — Truc Nguyen
(74) *Attorney, Agent, or Firm* — Eckert Seamans Cherin & Mellott, LLC; Brij K. Agarwal

(57) ABSTRACT

An improved bellows for use in a vacuum interrupter includes a plurality of corrugations extending along a central axis, with each convolution including a convolution element and a support element. Each convolution element has a convolution length along the central axis and a convolution height perpendicular to the central axis. In a first embodiment, the convolution height of the various corrugations increases between two ends of the bellows. In an embodiment, the bellows height increases gradually between the two ends, and in another embodiment the convolution height increases in a stepwise fashion. The convolution length can likewise change gradually or stepwise between the ends of the bellows. The convolution height alternatively can remain the same throughout a bellows, but the convolution length may change.

16 Claims, 6 Drawing Sheets

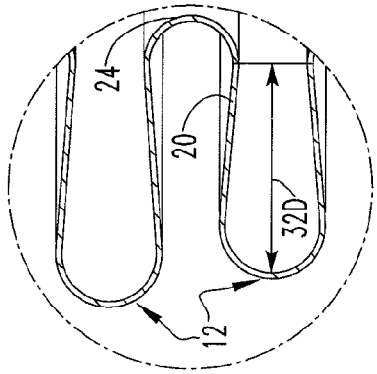
FIG. 1A
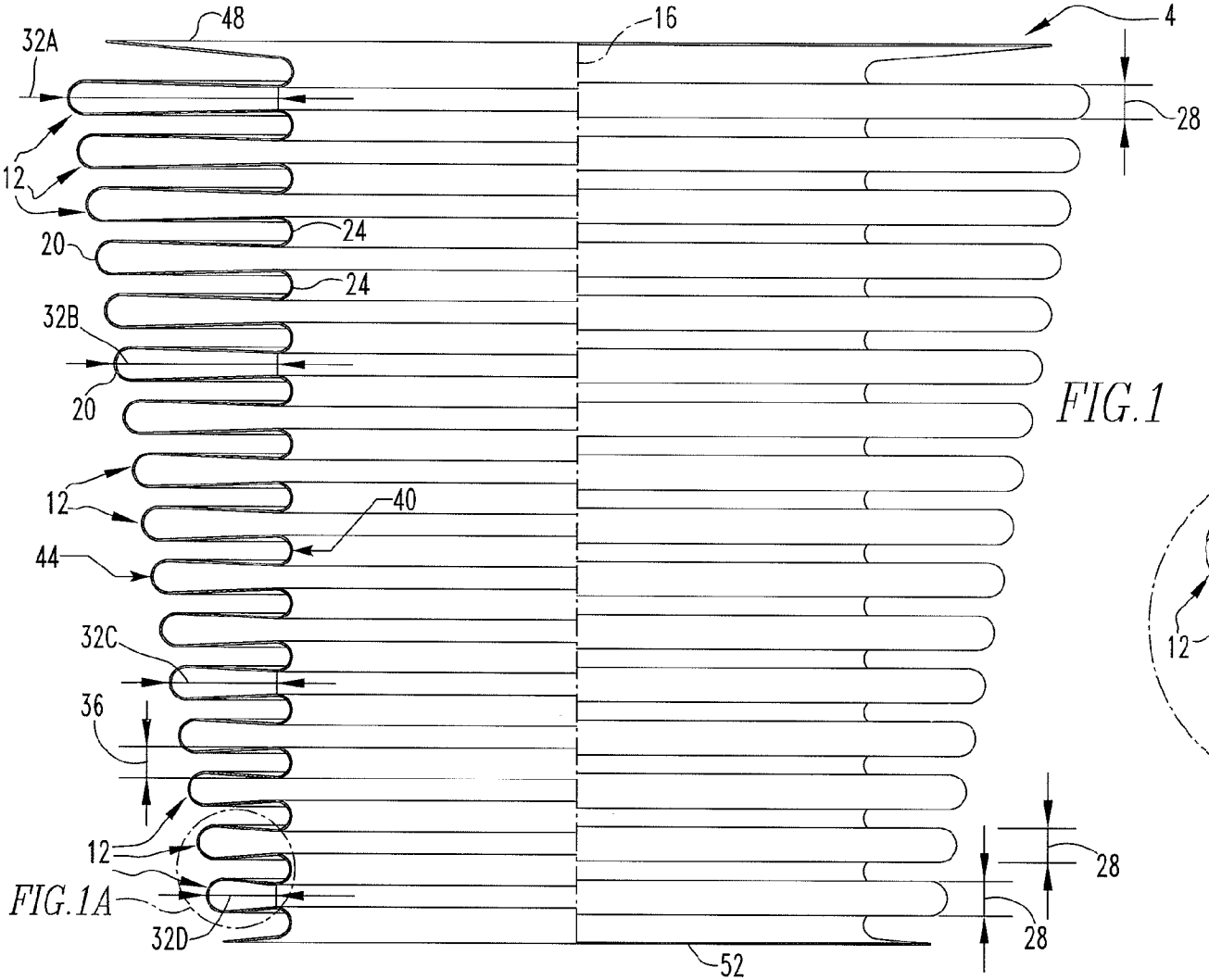
FIG. 1
FIG. 1A

BELLOWS FOR USE IN VACUUM INTERRUPTERS

BACKGROUND

1. Field

The disclosed and claimed concept relates generally to vacuum interrupters and, more particularly, to a bellows for use in an evacuated envelope of a vacuum interrupter.

2. Related Art

Vacuum interrupters are generally known in the relevant art. Vacuum interrupters employ a set of separable contacts that are situated within an evacuated envelope to facilitate the rapid extinction of any arc that may propagate between the separable contacts when they are in the process of separating during a trip event. The two separable contacts, one being movable and the other being fixed, are situated within the evacuated envelope, with the movable contact being connected with a compressible bellows that maintains the evacuated nature of the envelope even during movement of the movable contact. Such vacuum interrupters are themselves typically incorporated into a vacuum circuit interrupter that employs a separate vacuum interrupter on each pole.

While such bellows have been generally effective for their intended purposes, they have not been without limitation. When the set of separable contacts are separated from the closed state, or closed from the open state, the movable contact moves with great speed and thus energy, meaning that one end of the bellows is rapidly accelerated and then rapidly decelerated, while the opposite end of the bellows remains fixed. Since the bellows typically are formed of a thin metal, such bellows have been sometimes known to rupture due to their inability to withstand the mechanical forces inherent in the separation of the separable contacts, repeatedly, for tens of thousands times. It thus would be desirable to provide an improved bellows that meets these and other needs.

SUMMARY

An improved bellows for use in a vacuum interrupter includes a plurality of corrugations extending along a central axis, with each convolution including a convolution element and a support element. Each convolution element has a convolution length along the central axis and a convolution height perpendicular to the central axis. In a first embodiment, the convolution height of the various corrugations increases between two ends of the bellows. In an embodiment, the bellows height increases gradually between the two ends, and in another embodiment the convolution height increases in a stepwise fashion. The convolution length can likewise change gradually or stepwise between the ends of the bellows. The convolution height alternatively can remain the same throughout a bellows, but the convolution length may change.

What has greatly limited the ability of know bellows to withstand tens of thousands of opening and closing operations in high impact applications as vacuum interrupters is the continued oscillation of the convolutions even after a movable portion of the vacuum interrupter has come to a complete stop. The oscillations initially result from the kinetic energy given to the elastic convolutions by the external breaker mechanism. In order to damp such oscillations, heat is generated by the repeated elastic deformation cycles of the convolutions.

However, if many of the convolutions of a bellows have a common shape and hence resonant oscillation frequency, such convolutions will oscillate in a synchronized fashion, as if they were a single piece. That is, there will be no relative opening and closing within and between such convolutions. In such a situation, the damping of oscillations in such known bellows occurs generally only at the region between the convolutions having the common shape and the first one or two end convolutions, which are rigid as they are affixed to the outside massive assembly, by way of example. This is why such known bellows have tended to fail at the first one or two convolutions at either end.

The solution presented herein is to provide convolutions having various shapes within the same bellows. This advantageously promotes relative motion of opening and closing, i.e. elastic deformation, within and among many of not all the convolutions of the bellows.

Accordingly, an aspect of the disclosed and claimed concept is to provide an improved bellows for use in an evacuated envelope of a vacuum interrupter, and to provide such an improved vacuum interrupter.

Another aspect of the disclosed and claimed concept is to provide a bellows for use in a vacuum interrupter in which, upon an event that opens or closes a set of closed contacts, vibrations in the bellows are quickly dissipated and the duty of damping the oscillations is distributed across most if not all of the bellows convolutions.

The disclosed and claimed concept is provided with the intention to vary the natural oscillation frequency of many of the convolutions of a bellows. The dominating principle is to resist synchronized movement of the convolutions and to desirably spread the duty of dissipating the energy of the oscillations across many of the convolutions of the bellows.

These and other aspects of the disclosed and claimed concept are provided by an improved bellows for a vacuum interrupter having an evacuated envelope. The bellows in a free state can be generally stated as including a plurality of convolution elements and a plurality of support elements alternately connected together and being symmetric about an axis that extends centrally through the bellows, each adjacent pair of convolution elements being connected with and spaced apart by an intervening support element, and each adjacent pair of support elements being connected with and spaced apart by an intervening convolution element; each convolution element being of a convolution length along the axis and being of a convolution height perpendicular to the axis; each support element being of a spacing length along the axis; and at least one of: at least a first convolution element having a convolution length different than that of another convolution element situated adjacent the at least first convolution element, and at least a first support element having a spacing length different than that of another support element situated adjacent the at least first support element.

Other aspects of the disclosed and claimed concept are provided by an improved bellows for a vacuum interrupter having an evacuated envelope. The bellows in a free state can be generally stated as including a plurality of convolution elements and a plurality of support elements alternately connected together and being symmetric about an axis that extends centrally through the bellows, each adjacent pair of convolution elements being connected with and spaced apart by an intervening support element; each convolution element being of a convolution length along the axis and being of a convolution height perpendicular to the axis; and the convolution height of a first convolution element at or near a first end of the bellows being greater than that of a second convolution element at or near a second end of the bellows.

Other aspects of the disclosed and claimed concept are provided by an improved vacuum interrupter comprising the bellows as set forth in either preceding paragraph. Still other aspects of the disclosed and claimed concept are provided by an improved circuit interrupter comprising a number of the vacuum interrupters and an operating mechanism operatively connected with the number of vacuum interrupters.

BRIEF DESCRIPTION OF THE DRAWINGS

A further understanding of the disclosed and claimed concept can be gained from the following Description when read in conjunction with the accompanying drawings in which:

FIG. 1 is an elevational view of a first embodiment of an improved bellows in accordance with the disclosed and claimed concept;

Similar numerals refer to similar parts throughout the specification.

DESCRIPTION

Figure 2:
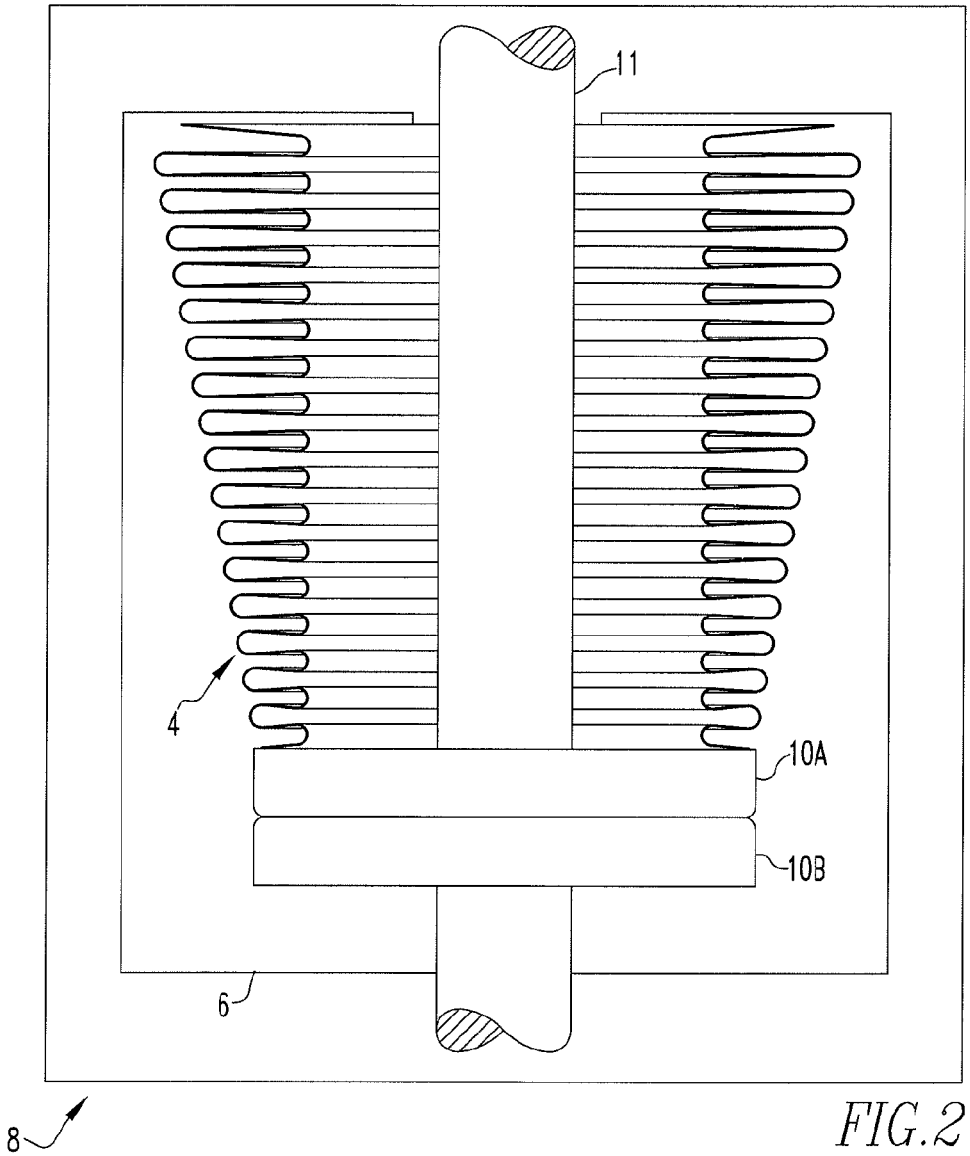
FIG. 2 is a schematic depiction of an improved vacuum interrupter employing the improved bellows of FIG. 1.
Figure 2A:
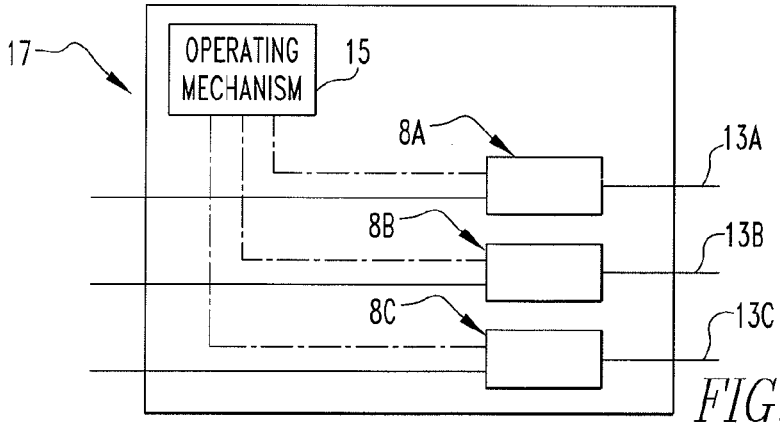
FIG. 2A is a schematic depiction of a circuit interrupter that employs a plurality of the vacuum interrupters of FIG. 2.

An improved bellows for in accordance with the disclosed and claimed concept is depicted in FIG. 1. As can be understood from FIG. 2, the bellows 4 can be incorporated into an evacuated envelope 6 of a vacuum interrupter 8 that is schematically depicted in FIG. 2. As is understood in the relevant art, the evacuated envelope 6 has a hollow interior that is evacuated or that has a reduced pressure and within which are disposed a pair of separable contacts 10A and 10B. During a trip event, the separable contacts 10A and 10B separate from one another at a very high velocity which, within the interior of the evacuated envelope 6, results in minimal arcing and fast recovery of dielectric strength between the separable contacts 10A and 10B. However, since the contact 10A is disposed on a movable post, and since the bellows 4 sealingly extends between the post 11 and the evacuated envelope 6, the bellows 4 experiences a high level of acceleration followed by a correspondingly high level of deceleration when the pair of separable contacts 10A and 10B are separated. As will be understood in greater detail below, the bellows 4 in its various embodiments is advantageously configured to limit wear by avoiding extended oscillations when the set of separable contacts 10A and 10B are separated.

One or more of the vacuum interrupters 8 can be incorporated into a circuit interrupter 17 that employs a separate vacuum interrupter 8A, 8B, and 8C on each of a plurality of poles 13A, 13B, and 13C. The circuit interrupter 13 further includes an operating mechanism 15 that is operatively connected with each of the vacuum interrupters 8A, 8B, and 8C to open and close the sets of separable contacts in certain predetermined conditions.

The improved bellows 4 comprises a plurality of convolutions 12 that extend along a central axis 16. When the post 11 moves during an event that causes separation of the separable contacts 10A and 10B, the post 11 moves generally along the direction of the central axis 16. As such, the oscillations that are desirably dissipated after such an occurrence are those that occur along the direction of the central axis 16. In one aspect, the improved bellows 4 rapidly dissipates oscillations along the central axis 16 by making at least certain adjacent convolutions 12 different from one another in various respects. That is, the improved bellows 4 is configured such that the convolutions 12 are not all identical to one another, because an oscillation introduced with respect to a given convolution will be easily transferred to an identical adjacent convolution and so forth until the oscillation rebounds from an end of such a bellows and the oscillation is reflected in the opposite direction from one identical convolution to another. Advantageously, the improved bellows 4 dissipates oscillations that otherwise would occur along the central axis 16 by making many, if not all, of the convolutions 12 different from one another.

As can be understood from FIG. 1, each convolution 12 comprises a convolution element 20 and a support element 24. The convolution elements and support elements 24 are generally U-shaped, with the open portions of the convolution elements 20 generally facing toward the central axis 16, and with the open portions of the support elements 24 facing generally away from the central axis 16.

Each convolution element 20 can be said to be of a convolution length 28 as measured along the central axis 16, i.e., parallel therewith, and is of a convolution height measured in a direction generally perpendicular to the central axis 16 and indicated in FIG. 1 generally at the numeral 32 and, more particularly, at the numerals 32A, 32B, 32C, and 32D. That is, it can be seen that the convolution height 32A of the convolution element 20 that is at or near a first end 48 of the bellows 4 is greater in magnitude than the convolution height 32D of the convolution element 20 at or near a second end 52 of the bellows. Moreover, it can be seen from FIG. 1 that the convolution height 32 of the convolution elements 20 gradually and progressively increases in a direction from the second end 52 toward the first end 48. As employed herein, the expression "progressively" and variations thereof may refer broadly to a linear increase or a nonlinear increase, whether or not expediential in nature.

The support elements 24 can be said to be of a spacing length 36 in a direction along the central axis 16. The support elements 24 can also be said to have a support radius 40. Similarly, the convolution elements 20 themselves have a convolution radius 44.

In the first embodiment of the bellows 4 depicted generally in FIG. 1, the convolution lengths 28 of the convolution elements 20 are equal. The spacing lengths 36 of the support elements 24 are also equal to one another. The support radii 40 of the support elements 24 are equal to one another. The convolution radii 44 of the convolution elements 20 are also equal to one another. However, it is reiterated that the convolution height 32 of the convolution elements 20 increases progressively. As such, the spring constant of each convolution 12 is different than that of any adjacent convolution 12. As such, a vibration at a given frequency in one convolution 12 will be minimally transferred to an adjacent convolution 12 since the adjacent convolution 12 will have different mechanical properties including a difference sprint constant, and thus the vibrations in one convolution 12 cannot be easily induced in an adjacent convolution 12. As such, oscillations that otherwise might occur in a direction parallel with the central axis 16 are rapidly dissipated and damped within the various convolutions 12 themselves rather than being damped and dissipated at, for example, a point of connection between the first end 48 or the second end 52 with a portion of the evacuated envelope 6 or, by way of further example at the first one to two convolutions immediately adjacent a joint with the evacuated envelope 6. This reduces localized wear by spreading such wear across many if not all of the convolutions on the bellows 4 and results in an advantageously relatively longer lifespan of the bellows 4.

Figure 3:
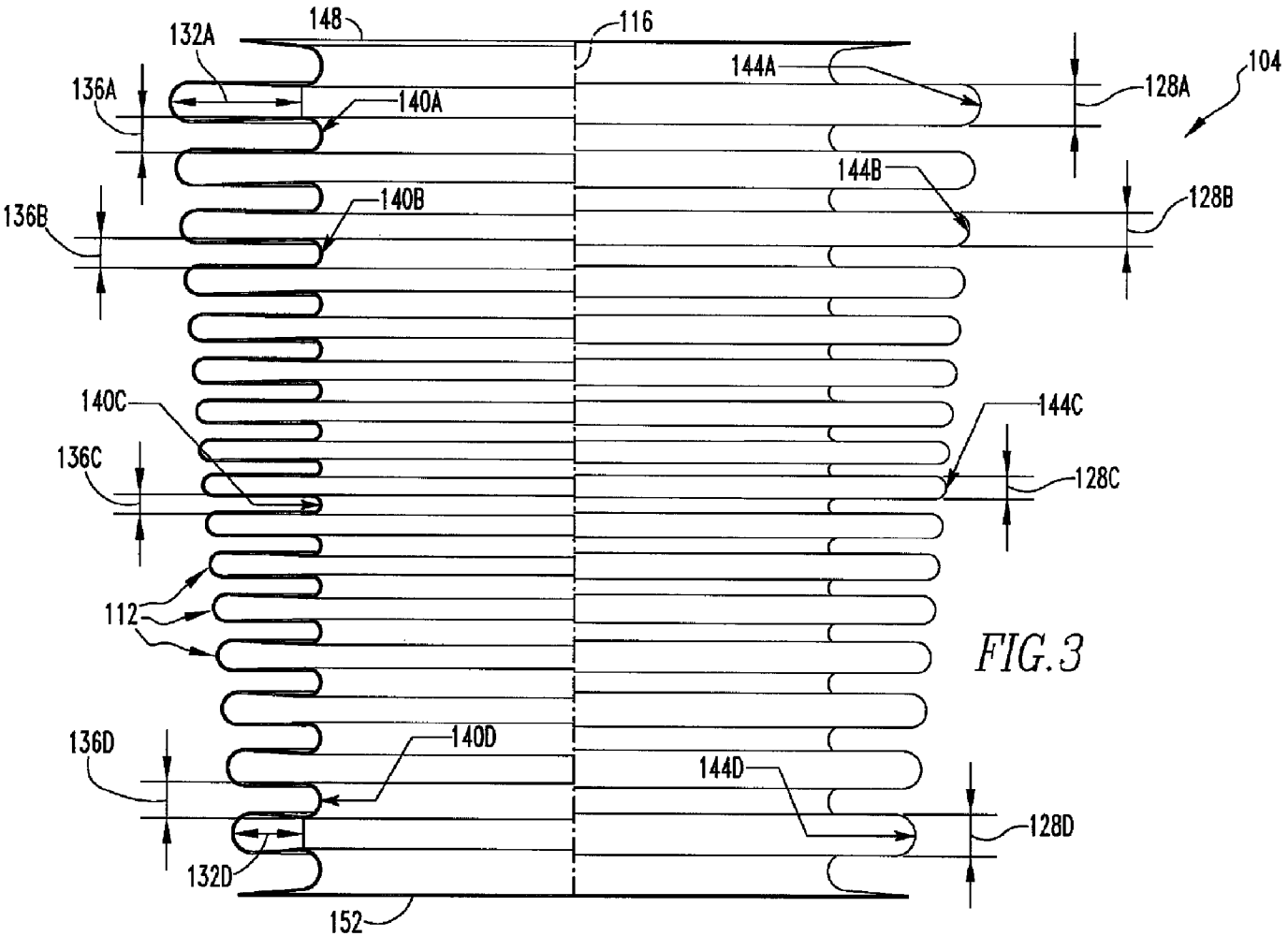
FIG. 3 is an elevational view of an improved bellows, partially cut away, in accordance with a second embodiment of the disclosed and claimed concept.

An improved bellows 104 in accordance with a second embodiment of the disclosed and claimed concept is depicted generally in FIG. 3. The bellows 104 includes a plurality of convolutions 112 extending along a central axis 116. While the convolution height 132 can be seen to gradually and progressively increase as is indicated between the convolution heights 132A and 132D, it can be seen that many of the convolutions 112 are also of a different convolution length 128 from one another. That is, the convolution length 128A is greater than that of the adjacent convolution length 128B until approximately the middle of the longitudinal length of the bellows 104, where the convolution length 128C is at its minimum. Thereafter, the convolution length progressively increases in a direction toward the second end 152 where the convolution length 128D is again relatively greater than many of the other convolutions 112. While the convolution length 128A and the convolution length 128D are depicted as being equal, this need not be the case in other embodiments.

Similarly in FIG. 3, the spacing length 136 is at its greatest at the first and second ends 148 and 152 and is reduced generally at the center, as is indicated at the numerals 136A, 136B, 136C, and 136D. The same can be said of the support radius, as is indicated at the numerals 140A, 140B, 140C, and 140D, and for the convolution radius, as is indicated at the numerals 144A, 144B, 144C, and 144D.

Thus it can be seen from FIG. 3 that the bellows 104 includes both a progressively increasing convolution height in going from one end of the bellows 104 to the other, but also includes a convolution length that progressively decreases and then increases from one end of the bellows 104 to the other. It thus can be seen that in addition to the dissipation of oscillations that is afforded by the varying convolution height 132, further dissipation of oscillations is afforded by the varying convolution length 128, spacing length 136, support radius 140, and convolution radius 144.

Figure 4:
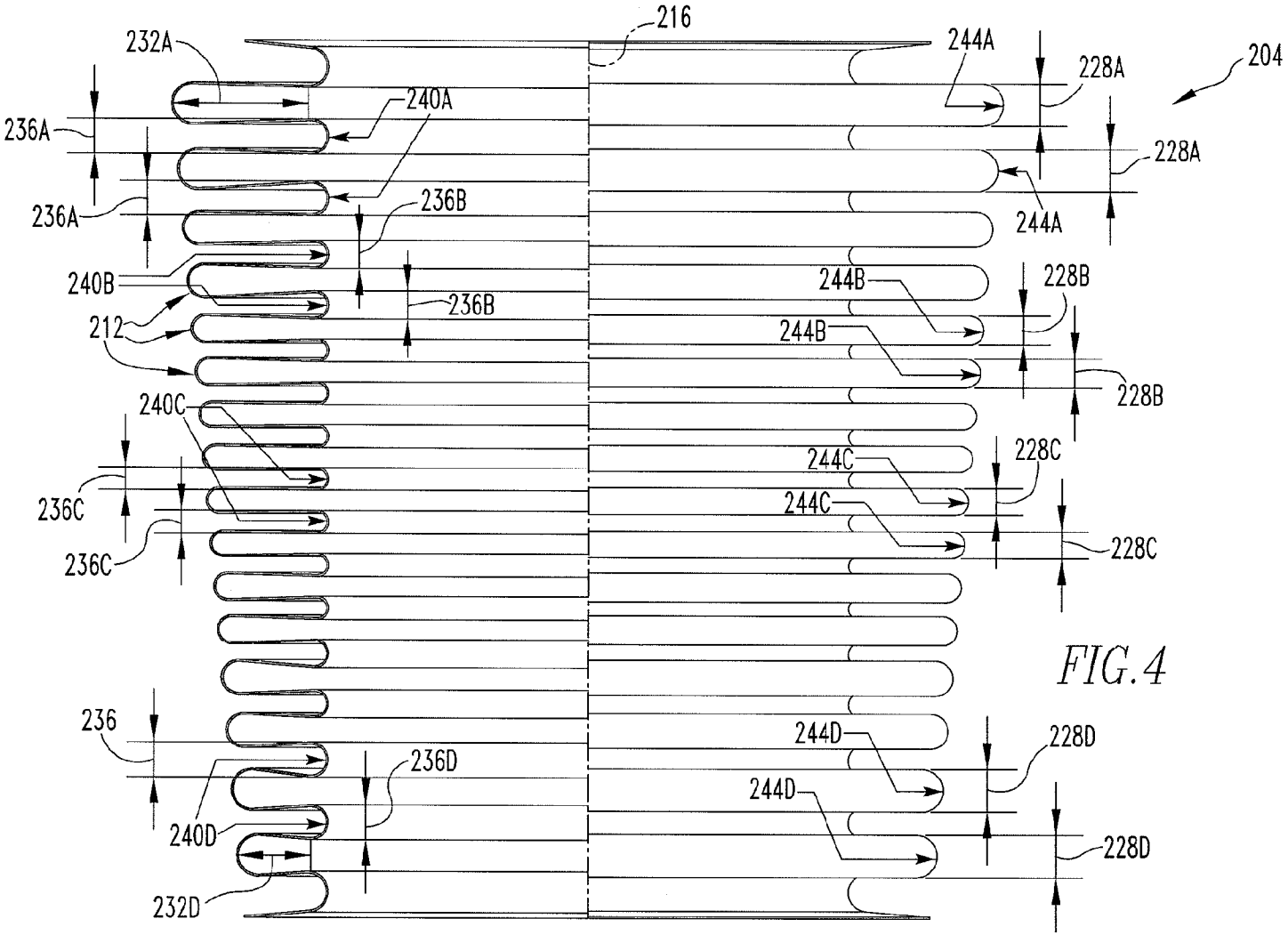
FIG. 4 is an elevational view of an improved bellows, partially cut away, in accordance with a third embodiment of the disclosed and claimed concept.

A third embodiment of a bellows 204 in accordance with the disclosed and claimed concept is depicted generally in FIG. 4. The bellows 204 is similar to the bellows 104 of FIG. 3, except that the convolution length 228 of the bellows 204 changes in a stepwise fashion rather than changing progressively as in the bellows 104. That is, while the bellows 104 includes a plurality of convolutions 212 extending along a central axis 216, and while the convolution height 232 changes gradually and progressively between opposite ends, as is indicated between the two convolution heights 232A and 232D, it can be seen that the convolution length 228 of certain convolutions 212 is equal to that of an adjacent convolution 212.

More particularly, it can be seen that two convolutions 212 have the same convolution length 228A. These same two convolutions 212 have an equal spacing length 236A, an equal support radius 240A, and an equal convolution radius 244A. A pair of convolutions 212 adjacent thereto likewise have an equal convolution length 228B, an equal spacing length 236B, an equal support radius 240B, and an equal convolution radius 244B. However, it can be seen from FIG. 4 that the convolution lengths 228A and 228B are unequal, as are the spacing lengths 236A and 236B, the support radii 240A and 240B, and the convolution radii 244A and 244B. At about the middle of the bellows 204, a number of the convolutions 212 have a minimal convolution length 228C, spacing length 236C, support radius 240C, and convolution radius 244C. A pair of convolutions 212 at an opposite end of the bellows 204 thereafter have an equal and increased convolution length 228D, spacing length 236D, support radius 240D, and convolution radius 244D.

It thus can be seen that the bellows 204 has a convolution height 232 that changes progressively from one end to the other, whereas its convolution length 228, its spacing length 236, its support radius 240, and its convolution radius 244 each change in a stepwise fashion. In this regard, it is understood that not all of the convolution length 228, the spacing length 236, the support radius 240, and the convolution radius 244 need to vary in the same fashion as one another. That is, one or more might increase while others stay the same or decrease, in any combination. Another improved bellows 304 in accordance with a fourth embodiment of the disclosed and claimed concept is depicted generally in FIG. 5. The bellows 304 is similar to the bellows 204, except that the convolution height 332 varies in a stepwise fashion in the bellows 304 rather than changing in a progressive fashion, as in the bellows 204. That is, the convolution lengths of plural adjacent quantities of the convolutions 312 decrease and then increase in a direction along the central axis 316, as is indicated that the numerals 328A, 328B, 328C, 328D, and 328E. The convolution height 332 also changes in a stepwise fashion, as is indicated at the numerals 332A, 332B, 332C, 332D, and 332E. The spacing length 336 decreases and then increases among groupings of the convolutions 312, as is indicated at the numerals 336A, 336B, 336C, 336D, and 336E. The same can be said of the support radius, as is indicated at the numerals 340A, 340B, 340C, and 340D, as well as the convolution radius as indicated at the numerals 344A, 344B, 344C, and 344D.

Figure 5:
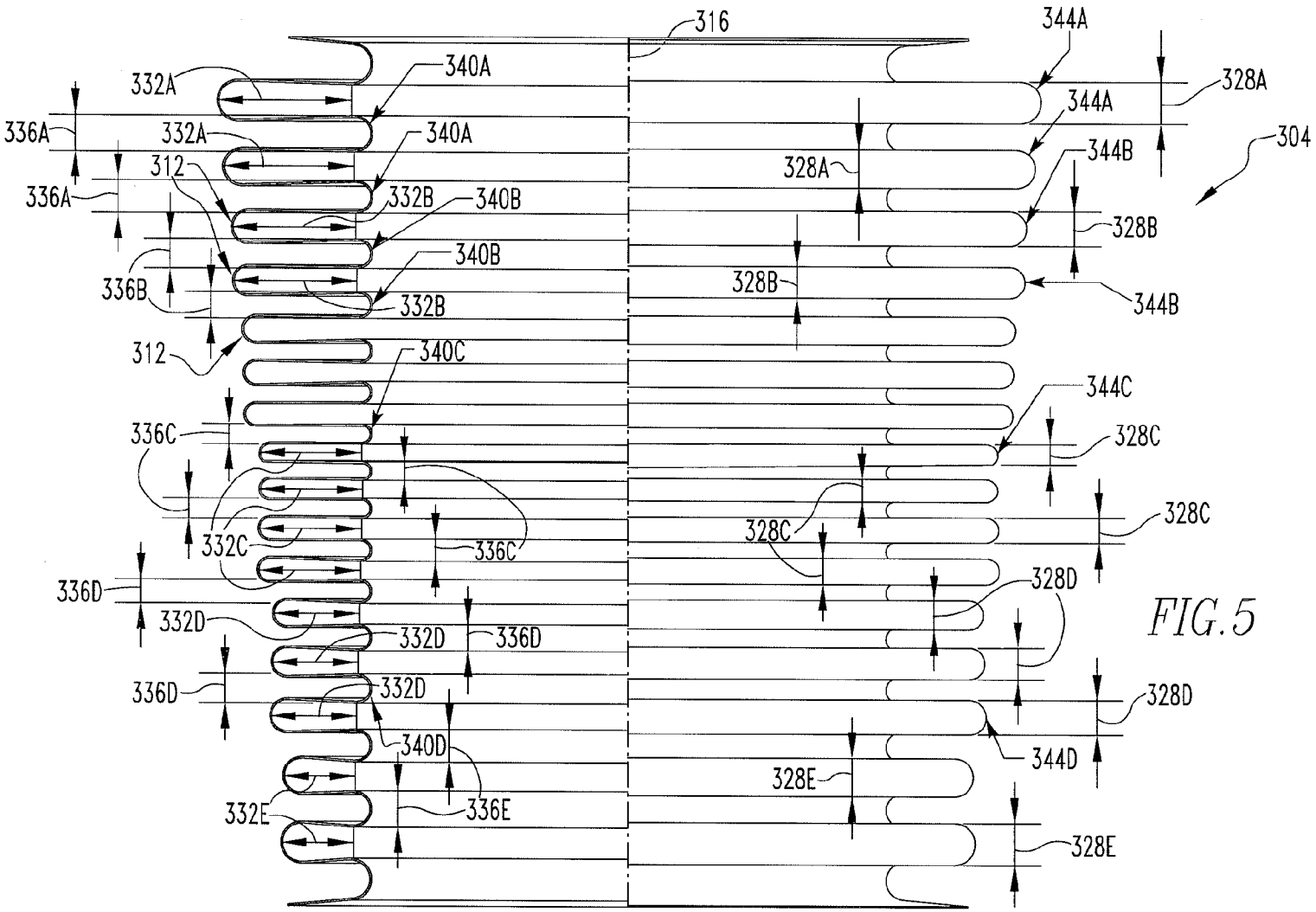
FIG. 5 is an elevational view of an improved bellows, partially cut away, in accordance with a fourth embodiment of the disclosed and claimed concept.

While the exemplary bellows 304 in FIG. 5 appears to be constructed in discrete groupings of convolutions 312 that each have similar properties, this need not necessarily be the case in other embodiments. That is, while the pair of convolutions 312 that have the equal convolution length 328 also have an equal convolution height 332A, an equal spacing length 336A, an equal support radius 340A, and an equal convolution radius 344A, it is understood that the equality or inequality of the various properties of convolutions 312 in any grouping can vary. In other words, it can be understood that by varying the convolution length 328, the convolution height 332, the spacing length 336, the support radius 340, and the convolution radius 344 that oscillations can be rapidly dissipated in the bellows 304, it is understood that such oscillations can be even more expeditiously dissipated by making further changes to the symmetry between adjacent convolutions 312 and adjacent groupings of convolutions 312.

In this regard, it should be understood that the embodiments depicted in FIGS. 1 and 3-5 each contain various varying properties and that such properties can be combined in other combinations without limitation. By way of example, the stepwise change in convolution length as indicated at the numerals 328A, 328B, 328C, 328D, and 328E could itself be incorporated into the bellows 4 without the other variations that are present in the bellows 304 to provide another embodiment of a bellows in accordance with the disclosed and claimed concept that is not expressly depicted herein. Other combinations of the features depicted herein will be apparent to those skilled in the art.

Figure 6:
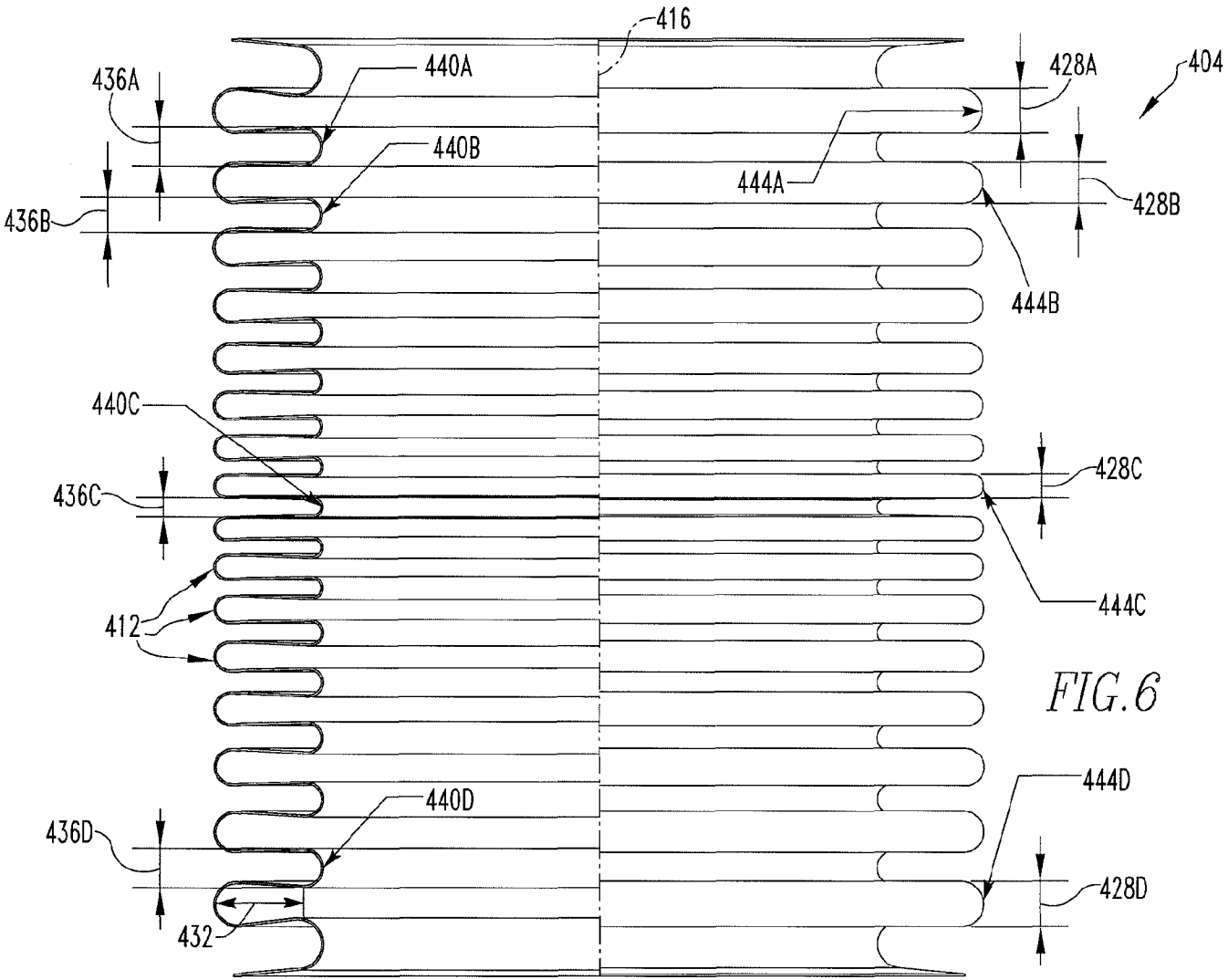
FIG. 6 is an elevational view of an improved bellows, partially cut away, in accordance with a fifth embodiment of the disclosed and claimed concept.

A fifth embodiment of an improved bellows 404 in accordance with the disclosed and claimed concept is depicted generally in FIG. 6. The bellows 404 includes a plurality of convolutions 412 extending along a central axis 416, but the convolution height 432 of each of the convolutions 412 is equal. However, the convolution length as indicated the numerals 428A, 428B, 428C, and 428D progressively decreases and then increases in a fashion similar to that of the bellows 104 of FIG. 3. Moreover, the same can be said of the spacing length 436A, 436B, 436C, and 436D; the support radius 440A, 440B, 440C, and 440D; and the convolution radius 444A, 444B, 444C, and 444D. In this regard, it should be understood that the features and variations presented in the embodiments of FIGS. 3-5 can be implemented in any combination into the generally cylindrical bellows 404 of FIG. 6 without departing from the present concept. Further combinations of the features from the foregoing, which can be combined in any fashion, will be apparent to one skilled in the art.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A bellows for a vacuum interrupter having an evacuated envelope, the bellows in a free state comprising:

a plurality of convolution elements and a plurality of support elements alternately connected together and being symmetric about an axis that extends centrally through the bellows, each adjacent pair of convolution elements being connected with and spaced apart by an intervening support element, and each adjacent pair of support elements being connected with and spaced apart by an intervening convolution element;

each convolution element being of a convolution length along the axis and being of a convolution height perpendicular to the axis;

each support element being of a spacing length along the axis; and at least one of:

at least a first convolution element having a first convolution length different than another convolution length of another convolution element situated adjacent the at least first convolution element, and at least a first support element having a first spacing length different than another spacing length of another support element situated adjacent the at least first support element.

2. The bellows of claim 1 wherein:

at least a first convolution element has a first convolution length different than another convolution length of another convolution element situated adjacent the at least first convolution element; and an additional convolution element situated adjacent one of the at least first convolution element and the another convolution element having an additional convolution length different than that of the one of the at least first convolution element and the another convolution element.

3. The bellows of claim 1 wherein:

at least a first convolution element has a first convolution length different than another convolution length of another convolution element situated adjacent the at least first convolution element; and an additional convolution element situated adjacent one of the at least first convolution element and the another convolution element having an additional convolution length equal to that of the one of the at least first convolution element and the another convolution element.

4. The bellows of claim 3 wherein a further convolution element situated adjacent the other of the at least first convolution element and the another convolution element having a further convolution length equal to that of the other of the at least first convolution element and the another convolution element.

5. The bellows of claim 1 wherein:

at least a first convolution element has a first convolution length different than another convolution length of another convolution element situated adjacent the at least first convolution element; and a support element disposed between the at least a first convolution element and the another convolution element having a first spacing length different than another spacing length of another support element situated adjacent the at least first support element.

6. The bellows of claim 1 wherein a first convolution height of a first convolution element at or near a first end of the bellows is greater than a second convolution height of a second convolution element at or near a second end of the bellows.

7. The bellows of claim 6 wherein the convolution height of a plurality of convolution elements situated between the first convolution element and the second convolution element progressively increases in a direction from the second convolution element toward the first convolution element.

8. The bellows of claim 1 wherein:

at least a first convolution element has a first convolution length different than another convolution length of another convolution element situated adjacent the at least first convolution element;

at least some of the convolution elements each comprising a radiused portion having a radius and being situated opposite its connection with a support element; and the radiused portion of the at least first convolution element having a first radius different than another radius of the another convolution element.

9. A bellows for a vacuum interrupter having an evacuated envelope, the bellows in a free state comprising:

a plurality of convolution elements and a plurality of support elements alternately connected together and being symmetric about an axis that extends centrally through the bellows, each adjacent pair of convolution elements being connected with and spaced apart by an intervening support element;

each convolution element being of a convolution length along the axis and being of a convolution height perpendicular to the axis;

one convolution element having a first convolution length different than another convolution length of another convolution element situated adjacent the one convolution element; and a first convolution height of a first convolution element at or near a first end of the bellows being greater than a second convolution height of a second convolution element at or near a second end of the bellows.

10. The bellows of claim 9 wherein the convolution height of a plurality of convolution elements situated between the first convolution element and the second convolution element progressively increases in a direction from the second convolution element toward the first convolution element.

11. The bellows of claim 9 wherein an additional convolution element situated adjacent one of the one convolution element and the another convolution element has a convolution length different than that of the one of the one convolution element and the another convolution element.

12. The bellows of claim 9 wherein an additional convolution element situated adjacent one of the one convolution element and the another convolution element has a convolution length equal to that of the one of the one convolution element and the another convolution element.

13. A bellows for a vacuum interrupter having an evacuated envelope, the bellows in a free state comprising:

a plurality of convolution elements and a plurality of support elements alternately connected together and being symmetric about an axis that extends centrally through the bellows, each adjacent pair of convolution elements being connected with and spaced apart by an intervening support element;

each convolution element being of a convolution length along the axis and being of a convolution height perpendicular to the axis;

a first convolution height of a first convolution element at or near a first end of the bellows being greater than a second convolution height of a second convolution element at or near a second end of the bellows; and wherein the convolution height of a plurality of convolution elements situated between the first convolution element and the second convolution element increases in a stepwise fashion a direction from the second convolution element toward the first convolution element.

14. The bellows of claim 9 wherein:

each adjacent pair of support elements is connected with and spaced apart by an intervening convolution element;

each support element is of a spacing length along the axis; and at least a first support element has a spacing length different than that of another support element situated adjacent the at least first support element.

15. A vacuum interrupter comprising the bellows as set forth in claim 1 and an evacuated envelope.

16. A circuit interrupter comprising a number of vacuum interrupters as set forth in claim 15 and an operating mechanism operatively connected with the number of vacuum interrupters.

* * * * *